US007950246B1

(12) United States Patent
Mayer et al.

(10) Patent No.: US 7,950,246 B1
(45) Date of Patent: May 31, 2011

(54) ASSEMBLY OF ABUTTING VACUUM INSULATED PANELS ARRANGED TO FORM A RETENTION CHAMBER WITH A SLIP SURFACE INTERPOSED BETWEEN THE PANELS

(75) Inventors: William N. Mayer, White Bear Lake, MN (US); William T. Mayer, Stacy, MN (US); Kurt O. Mankell, Minnetonka, MN (US)

(73) Assignee: Minnesota Thermal Science, LLC, Plymouth, MN (US)

( * ) Notice: Subject to any disclaimer, the term of this patent is extended or adjusted under 35 U.S.C. 154(b) by 79 days.

(21) Appl. No.: 12/030,442

(22) Filed: Feb. 13, 2008

(51) Int. Cl.
*F25D 3/08* (2006.01)

(52) U.S. Cl. ..... 62/371; 62/440; 62/457.1; 62/457.2; 220/592.25

(58) Field of Classification Search ..... 52/309.8, 52/309.9, 309.14, 783.1, 794.1; 428/69, 428/71; 220/560.12, 560.15, 592.27, 592.25, 220/592.26, 592.23
See application file for complete search history.

(56) References Cited

U.S. PATENT DOCUMENTS

| | | | | | |
|---|---|---|---|---|---|
| 1,936,214 | A | * | 11/1933 | Sommers | 220/560.12 |
| 2,020,845 | A | * | 11/1935 | Marshall | 52/784.15 |
| 2,496,296 | A | | 2/1950 | Frederick | |
| 2,961,116 | A | * | 11/1960 | Jeppson | 220/592.26 |
| 3,077,426 | A | * | 2/1963 | Johnston | 181/286 |
| 3,093,259 | A | * | 6/1963 | Morrison | 220/592.25 |
| 3,786,613 | A | * | 1/1974 | Shepheard | 52/784.13 |
| 3,974,658 | A | | 8/1976 | Starrett | |
| 3,993,811 | A | * | 11/1976 | Walles | 428/35.9 |
| 4,044,449 | A | * | 8/1977 | Phan | 29/460 |
| 4,145,895 | A | | 3/1979 | Hjertstrand et al. | |
| 4,147,004 | A | * | 4/1979 | Day et al. | 52/309.9 |
| 4,319,629 | A | | 3/1982 | Hotta | |
| 4,324,111 | A | | 4/1982 | Edwards | |
| 4,444,821 | A | * | 4/1984 | Young et al. | 428/69 |
| 4,527,370 | A | * | 7/1985 | Schuette | 52/282.3 |
| 4,529,638 | A | * | 7/1985 | Yamamoto et al. | 428/69 |
| 4,688,398 | A | | 8/1987 | Baek | |
| 4,877,128 | A | | 10/1989 | Strickland | |
| 4,892,226 | A | | 1/1990 | Abtahi | |
| 4,923,077 | A | | 5/1990 | Van Iperen | |
| 4,931,333 | A | | 6/1990 | Henry | |
| 5,032,439 | A | * | 7/1991 | Glicksman et al. | 428/44 |
| 5,050,387 | A | | 9/1991 | Bruce | |
| 5,088,301 | A | | 2/1992 | Piepenbrink | |
| 5,093,175 | A | * | 3/1992 | Goto et al. | 428/71 |

(Continued)

FOREIGN PATENT DOCUMENTS

DE 19915311 A1 * 10/2000

(Continued)

OTHER PUBLICATIONS

Verner, Carl. "Phase Change Thermal Energy Storage". Dissertation. May 1997.

*Primary Examiner* — Robert J Canfield
*Assistant Examiner* — Matthew J Gitlin
(74) *Attorney, Agent, or Firm* — Sherrill Law Offices, PLLC

(57) ABSTRACT

The invention is an assembly of abutting vacuum insulated panels configured and arranged to form a retention chamber with a slip surface providing a low kinetic coefficient of friction interposed between the panels within the abutment areas.

10 Claims, 4 Drawing Sheets

U.S. PATENT DOCUMENTS 5,226,557 A * 7/1993 Nelson ..... 206/523
5,273,801 A * 12/1993 Barry et al. ..... 428/69
5,316,171 A * 5/1994 Danner et al. ..... 220/592.21
5,435,142 A 7/1995 Silber
5,527,411 A * 6/1996 Jutte ..... 156/204
5,562,228 A 10/1996 Erioson
5,582,343 A 12/1996 Dalvey
5,756,179 A * 5/1998 Jutte ..... 428/69
5,758,513 A 6/1998 Smith
5,848,508 A * 12/1998 Albrecht ..... 52/309.9
5,875,599 A * 3/1999 McGrath et al. ..... 52/586.2
5,897,932 A * 4/1999 McGarth et al. ..... 428/69
5,899,088 A 5/1999 Purdum
5,924,302 A 7/1999 Derifield
6,164,030 A * 12/2000 Dietrich ..... 52/406.2
6,168,040 B1 * 1/2001 Sautner et al. ..... 220/592.1
6,209,343 B1 4/2001 Owen
6,223,551 B1 5/2001 Mitchell
6,233,965 B1 5/2001 Choy
6,250,104 B1 6/2001 Bostic
6,266,972 B1 * 7/2001 Bostic ..... 62/371
6,457,323 B1 10/2002 Marotta
6,467,323 B1 10/2002 Narushima et al.
6,474,095 B1 11/2002 Chan
6,502,417 B2 1/2003 Gano, III
6,718,776 B2 4/2004 Wessling
2002/0050147 A1 5/2002 Mai et al.
2002/0114937 A1 * 8/2002 Albert et al. ..... 428/304.4
2002/0144482 A1 * 10/2002 Henson et al. ..... 52/631
2004/0018335 A1 * 1/2004 Best ..... 428/69
2004/0074208 A1 * 4/2004 Olson et al. ..... 52/794.1
2004/0079794 A1 4/2004 Mayer
2004/0180176 A1 * 9/2004 Rusek, Jr. ..... 428/69
2005/0053755 A1 * 3/2005 Markey ..... 428/69
2005/0189404 A1 * 9/2005 Xiaohai et al. ..... 229/103.11
2006/0076863 A1 * 4/2006 Echigoya et al. ..... 312/401
2006/0277938 A1 * 12/2006 Meyer et al. ..... 62/371
2007/0119108 A1 * 5/2007 Downard ..... 52/289
2007/0152551 A1 * 7/2007 Kim et al. ..... 312/401
2007/0175236 A1 * 8/2007 Dryzun ..... 62/371
2007/0289976 A1 * 12/2007 Meyer et al. ..... 220/592.09
2008/0271402 A1 * 11/2008 Gingras ..... 52/506.02
2009/0039088 A1 * 2/2009 Williams et al. ..... 220/592.26
2009/0071088 A1 * 3/2009 Viegas et al. ..... 52/406.1
2009/0179541 A1 * 7/2009 Smith et al. ..... 312/406

FOREIGN PATENT DOCUMENTS

DE 10305550 A1 * 8/2004

* cited by examiner

ASSEMBLY OF ABUTTING VACUUM INSULATED PANELS ARRANGED TO FORM A RETENTION CHAMBER WITH A SLIP SURFACE INTERPOSED BETWEEN THE PANELS

BACKGROUND

Goods such as medical supplies, blood, and vaccines are often extremely temperature sensitive and need to be maintained within a given temperature range. Transport is particularly challenging. Such temperature sensitive goods are shipped to a variety of destinations where the ambient outside temperature varies from extreme cold to extreme heat.

In the prior art, shipment of temperature controlled supplies has been at least partially achieved by shipping containers lined with six separate vacuum insulation panels forming a container for the temperature sensitive goods. Vacuum insulated panels are extremely effective insulators as long as the internal vacuum remains intact. However, once the external barrier of the panels is breached and the vacuum ceases to exist, the thermal performance of the panels is reduced. The gas resistant outer film of the panel which seals the internal vacuum provides little protection. Therefore, a need exists for an assembly of vacuum insulated panels which have a greater abrasion and impact resistance.

SUMMARY OF THE INVENTION

The invention is an assembly of abutting vacuum insulated panels configured and arranged to form a retention chamber wherein a slip surface with a low kinetic coefficient of friction is interposed between the panels within the abutment areas to decrease the abrasive wear on the panels.

DETAILED DESCRIPTION OF A PREFERRED EMBODIMENT

Nomenclature

10 Container
19 Retention Chamber
20 Vacuum Insulated Panel
20*i* Open Cell Foam Core of VIP
20*o* Gastight Outer Film of VIP
21 Top Edge of Vacuum Insulated Panel
22 Bottom Edge of Vacuum Insulated Panel
23 Right Edge of the Panel
24 Left Edge of the Panel
25 First Major Surface of the Panel
26 Second Major Surface of the Panel
29 Abutment Area
30 Protective Sleeve
31 Top Edge of the Protective Sleeve

32 Bottom Edge of the Protective Sleeve
33 Right Edge of the Protective Sleeve
34 Left Edge of the Protective Sleeve
35 First Major Surface of the Protective Sleeve
36 Second Major Surface of the Protective Sleeve
39 Slip Surface Provided by the Protective Sleeve
40 Wear-Protected Insulating Panel
50 Adhesive Tape We have discovered that the useful life of a vacuum insulated panel 20 can be significantly increased by reducing abrasive wear of the airtight outer film 20*o* on the vacuum insulated panel 20, especially in those areas where one panel 20 abuts another panel 20 to form an insulated container 10 (hereinafter referenced as an abutment area 29).

Construction

Figure 1:
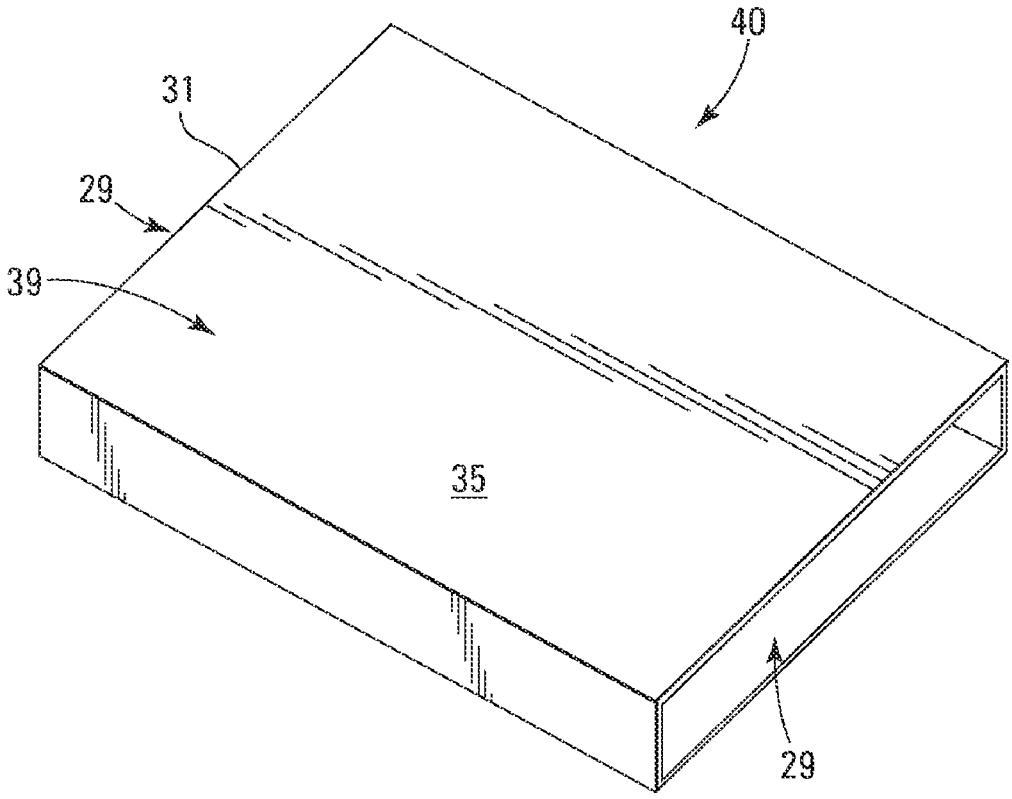
FIG. 1 is a perspective view of one embodiment of a wear-protected insulating panel.
Figure 2:
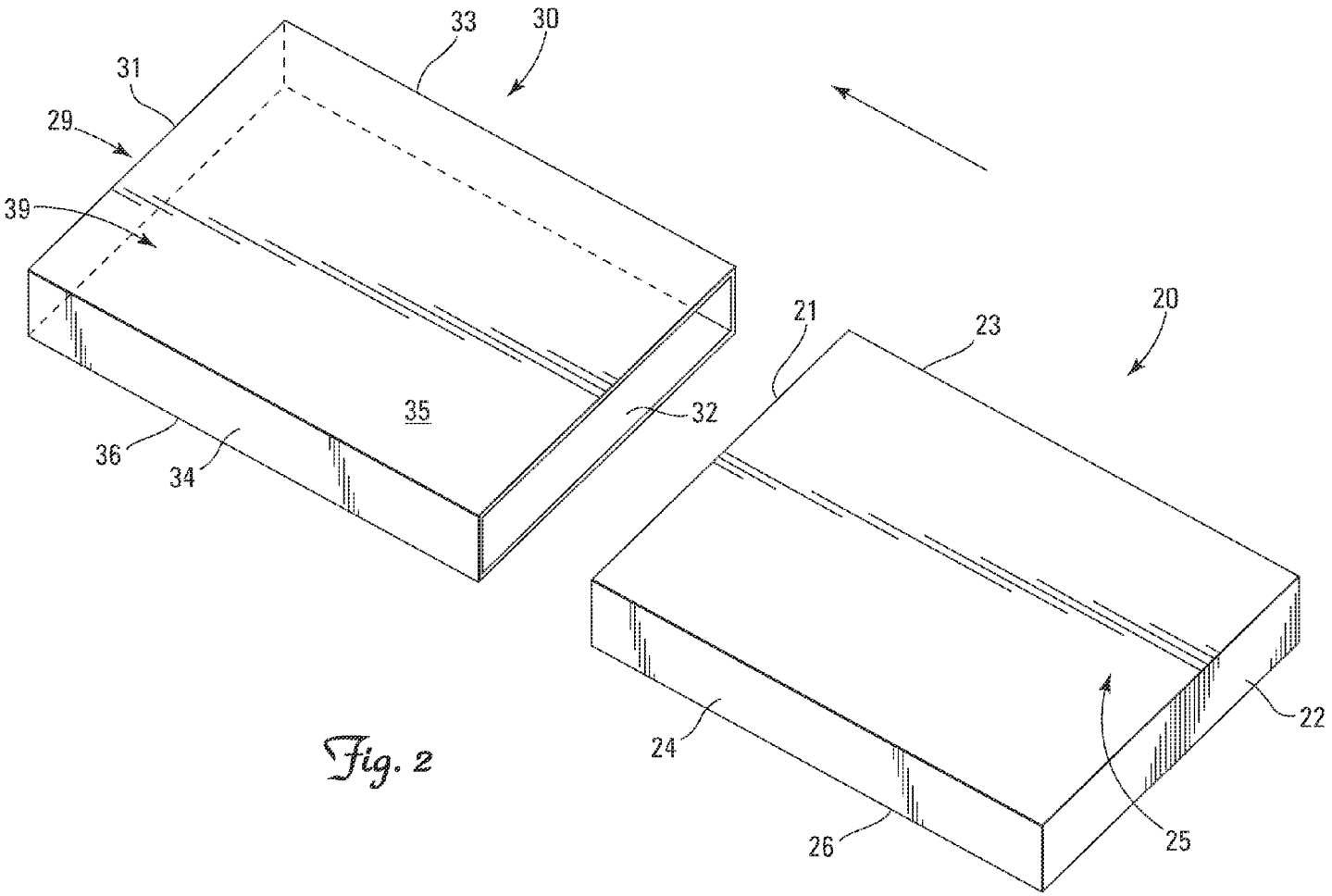
FIG. 2 is an exploded view of the wear-protected insulating panel subassembly depicted in FIG. 1.
Figure 3:
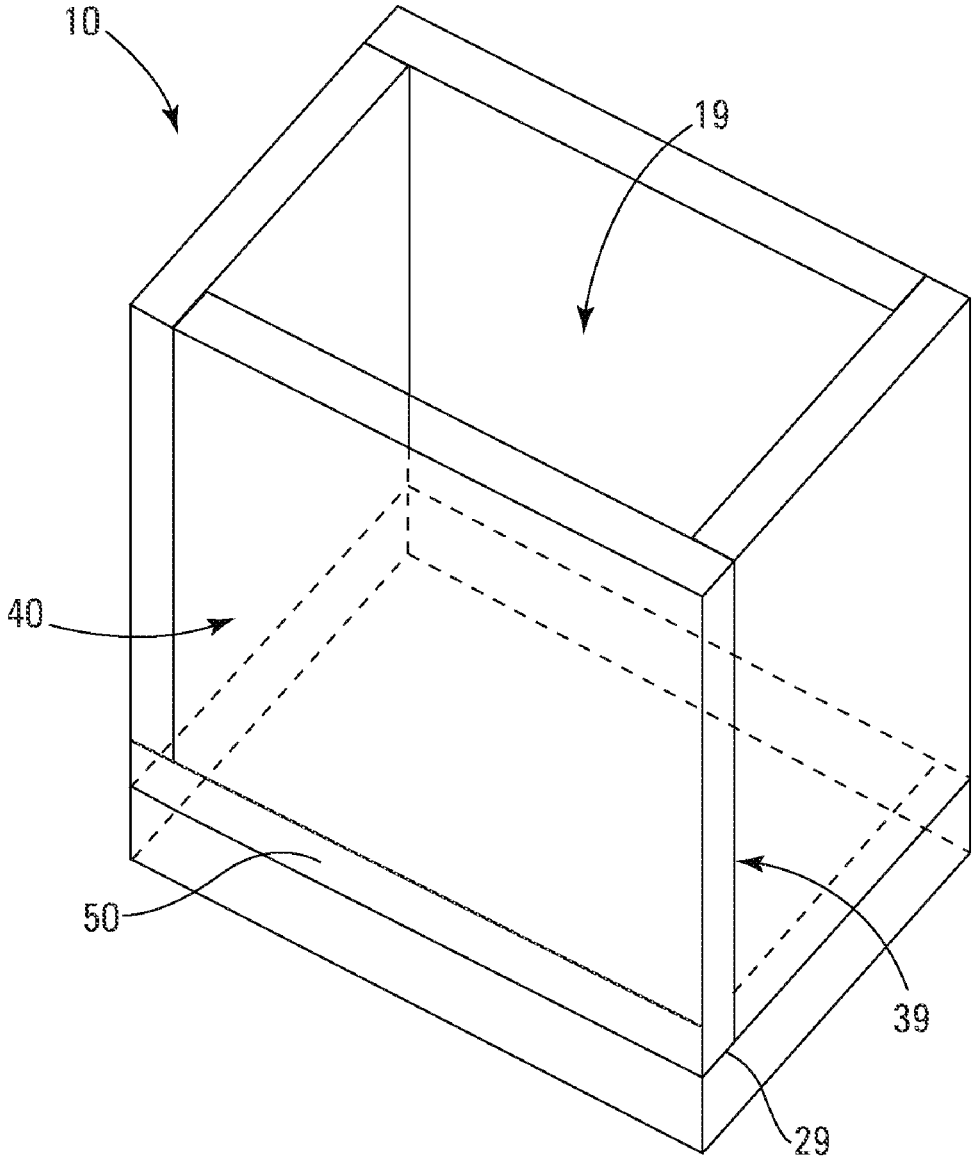
FIG. 3 is a perspective view of one embodiment of an insulated container constructed from several of the wear-protected insulating panels depicted in FIG. 1.
Figure 5:
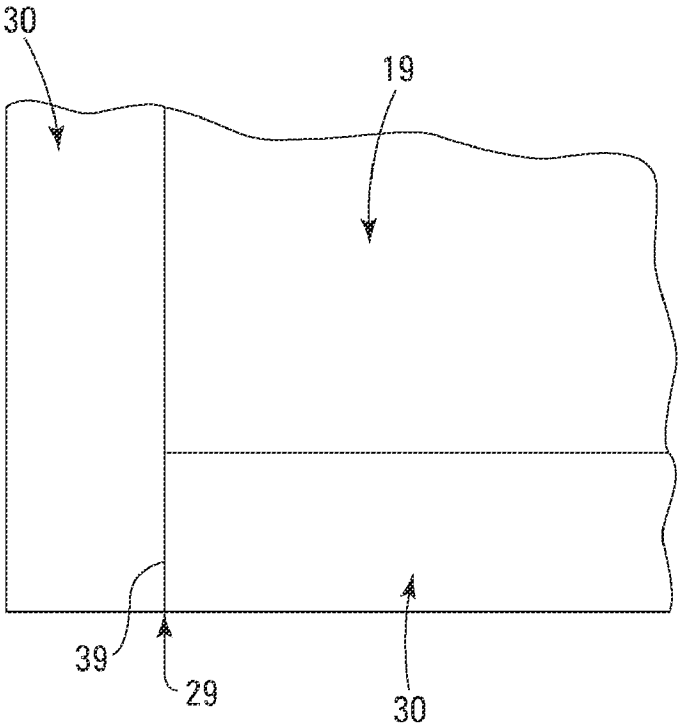
FIG. 5 is a top view of the corner depicted in FIG. 4.
Figure 4:
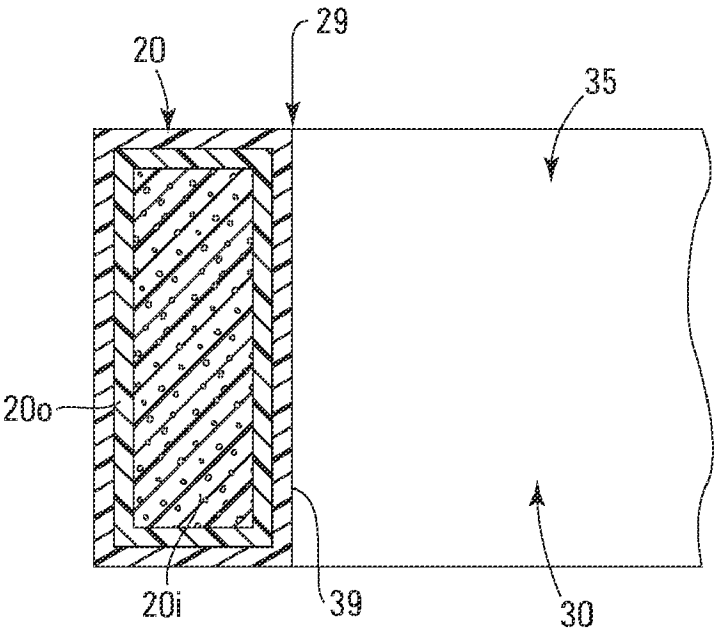
FIG. 4 is a side view of one corner of the container depicted in FIG. 3.

Referring to FIGS. 1-3, the invention is directed to a wear-protected insulating panel 40 useful in the construction of an insulated container 10 defining a retention chamber 19. The wear-protected insulating panel 40 includes a vacuum insulated panel 20 at least partially encased within a protective sleeve 30 effective for reducing abrasion of the vacuum insulated panel 20, especially within the abutment areas 29 formed when the vacuum insulated panels 20 are assembled to form an insulated container 10.

A vacuum insulated panel 20 is a technological advanced insulation product consisting of a cell foam core material 20*i* to which a vacuum is applied surrounded by a gas tight outer film 20*o*. A vacuum insulated panel 20 is a highly efficient insulator so long as the integrity of the vacuum is not compromised. Once the vacuum is lost, the panel 20 provides modest insulating value. A specific embodiment of a vacuum insulated panel 20 is depicted in FIGS. 1-5. The depicted vacuum insulated panel 20 includes a top edge 21, a bottom edge 22, a right edge 23, a left edge 24, a first major surface 25 and a second major surface 26. Abutment area 29 is formed when an edge of one panel 20 abuts a major surface of another panel 20 to form an insulated container 10.

The vacuum insulated panel 20 is at least partially encased within a protective sleeve 30 for protecting the integrity of the gastight outer film 20*o* on the vacuum insulated panel 20 against abrasion, especially within the abutment areas 29 where the film 20*o* is prone to significant wear. The sleeve 30 covers the first major surface 25 and the second major surface 26 of the panel 20 to protect the panel 20 from abrasion and puncture.

A specific embodiment of a sleeve 30 is depicted in FIGS. 1-5. The depicted sleeve 30 includes a top edge 31, a bottom edge 32, a right edge 33, a left edge 34 a first major surface 35 and a second major surface 36. The sleeve 30 covers at least three of the edges where one edge could be left open to accept insertion of a vacuum insulated panel 20 into the sleeve 30. The sleeve 30 provides a slip surface 39 (i.e., a surface with a low coefficient of friction) effective for minimizing abrasion of the panel 20 within the sleeve 30 as the panel 20 shifts relative to other items such as an abutting panel 20. A slip surface 39 with a coefficient of friction less than 0.50 minimizes the abrasion between the abutting panels 20. The sleeve 30 may be constructed from any number of suitable materials capable of providing puncture and abrasion resistance. Plastic films with a thickness of at least 7 mils provide suitable abrasion and puncture resistance. Such materials include specifically, but not exclusively PVC plastic film, Mylar® film or an acetate film.

An insulated container 10 formed from several wear protected insulated panels 40 encased is depicted in FIG. 3. A least four of the plurality of wear protected panels 40 are secured together with adhesive tape 50. As seen is FIGS. 4 and 5, the sleeve 30 provides a slip surface 39 within each of the abutment areas 29 on the container 10.

Use

As depicted in FIGS. 1-5, the vacuum isolation panel 20 is encased in the protective sleeve 30 to form the wear protected insulation panel 40. A plurality of wear protected insulated panels 40 are fitted together to form a retention chamber 19. A slip surface 39 is interposed between the abutting wear protected insulated panels 40 form the abutment area 29. The less abrasive abutment area 29 allows a tighter seal between panels 20 increasing overall thermal performance of the panel assembly 10. The panel assembly 10 is held together by an adhesive tape 50.

We claim:

1. An assembly, comprising:

(a) a plurality of vacuum insulated panels configured and arranged to form a retention chamber in which at least one panel abuts one other panel to form an abutment area, and (b) a slip surface interposed between the panels within the abutment area wherein the slip surface reduces kinetic coefficient of friction within the abutment area relative to a kinetic coefficient of friction that would exist within the abutment area without the slip surface.

2. The assembly of claim 1 wherein the slip surface is a sleeve encasing the vacuum insulated panel.

3. The assembly of claim 2 wherein the vacuum insulated panels each have first and second major surfaces and edges, and the sleeve covers at least the first and second major surfaces.

4. The assembly of claim 3 wherein the sleeve covers at least three of the edges.

5. The assembly of claim 2 wherein the sleeve is a plastic film.

6. The assembly of claim 5 wherein the plastic film is at least 7 mils thick.

7. The assembly of claim 5 wherein the plastic film is a polyvinylchloride film.

8. The assembly of claim 2 wherein at least four of the plurality of vacuum insulation panels encased within sleeves are secured together by an adhesive tape.

9. The assembly of claim 1 wherein at least one abutment area is formed by an edge of one panel abutting a major surface of another panel.

10. The assembly of claim 1 wherein the slip surface has a kinetic coefficient of friction of less than 0.50.

* * * * *